US010753657B2

(12) United States Patent
Dentes et al.

(10) Patent No.: US 10,753,657 B2
(45) Date of Patent: Aug. 25, 2020

(54) REFRIGERATION CAPACITY CONTROL DEVICE

(71) Applicant: Custom Controls Company, Houston, TX (US)

(72) Inventors: Dario Dentes, Houston, TX (US); Tim Rodwell, Spring, TX (US)

(73) Assignee: Custom Controls Company, a Texas corporation, Houston, TX (US)

( * ) Notice: Subject to any disclaimer, the term of this patent is extended or adjusted under 35 U.S.C. 154(b) by 0 days.

(21) Appl. No.: 16/158,274

(22) Filed: Oct. 11, 2018

(65) Prior Publication Data

US 2019/0078822 A1 Mar. 14, 2019

(51) Int. Cl.
*F25B 41/04* (2006.01)

(52) U.S. Cl.
CPC ..... *F25B 41/04* (2013.01); *F25B 41/043* (2013.01); *F25B 2400/0409* (2013.01); *F25B 2400/0411* (2013.01); *F25B 2500/17* (2013.01); *F25B 2500/28* (2013.01); *F25B 2700/21* (2013.01)

(58) Field of Classification Search
CPC ..... F25B 40/04; F25B 41/043; F25B 41/04; F25B 2400/0411; F25B 2400/0409; F25B 2500/28; F25B 2500/17; F25B 2700/21; Y10S 261/13
See application file for complete search history.

(56) References Cited

U.S. PATENT DOCUMENTS

| | | | | |
|---|---|---|---|---|
| 3,201,950 | A | 8/1965 | Shrader | |
| 5,040,380 | A * | 8/1991 | Gregory | F25B 41/00 165/908 |
| 5,052,190 | A * | 10/1991 | Gregory | F25B 41/00 165/164 |
| 5,129,449 | A | 7/1992 | Nguyen | |
| 5,240,651 | A | 8/1993 | Rawal | |
| 5,387,376 | A | 2/1995 | Gasser | |
| 5,626,030 | A * | 5/1997 | Nagai | F16K 1/54 62/324.6 |
| 6,276,154 | B1 * | 8/2001 | Pippin | F25B 41/043 417/300 |
| 6,371,442 | B1 * | 4/2002 | Hara | F16K 31/04 251/129.11 |
| 7,958,739 | B1 | 6/2011 | Leabo | |

(Continued)

FOREIGN PATENT DOCUMENTS

| | | |
|---|---|---|
| DE | 10 2015 016377 A1 | 6/2017 |
| EP | 0 354 037 A2 | 2/1990 |

(Continued)

OTHER PUBLICATIONS

Written Opinion of the International Search Authority (EPO) and International Search Report in PCT/US2018/055515 dated Jun. 18, 2019.

*Primary Examiner* — Tavia Sullens
(74) *Attorney, Agent, or Firm* — Hamby Law Firm; Bruce W. Hamby

(57) ABSTRACT

An apparatus, known as a refrigeration capacity control device, to continuously modulate the capacity of an air conditioning system, the apparatus comprising a liquid injection valve, a low pressure regulating valve, a pressure sensing line, a mixing chamber that contains thermodynamic catalyst fill material, and a mixing nozzle assembly.

3 Claims, 5 Drawing Sheets

(56) References Cited

U.S. PATENT DOCUMENTS

| | | | | |
|---|---|---|---|---|
| 2001/0027664 | A1* | 10/2001 | Ross | F25B 40/04<br>62/513 |
| 2004/0211477 | A1* | 10/2004 | Ezaki | F16K 31/423<br>137/877 |

FOREIGN PATENT DOCUMENTS

| | | | |
|---|---|---|---|
| EP | 2 405 209 | A1 | 1/2012 |
| WO | 2010039682 | A2 | 4/2010 |

* cited by examiner

REFRIGERATION CAPACITY CONTROL DEVICE

DESCRIPTION OF THE EMBODIMENTS

An apparatus is disclosed which will be called a Refrigeration Capacity Control Device; it is also referred to sometimes as an RCCD. A method of using an RCCD to continuously modulate capacity in an air conditioning system is also disclosed.

Figure 5:
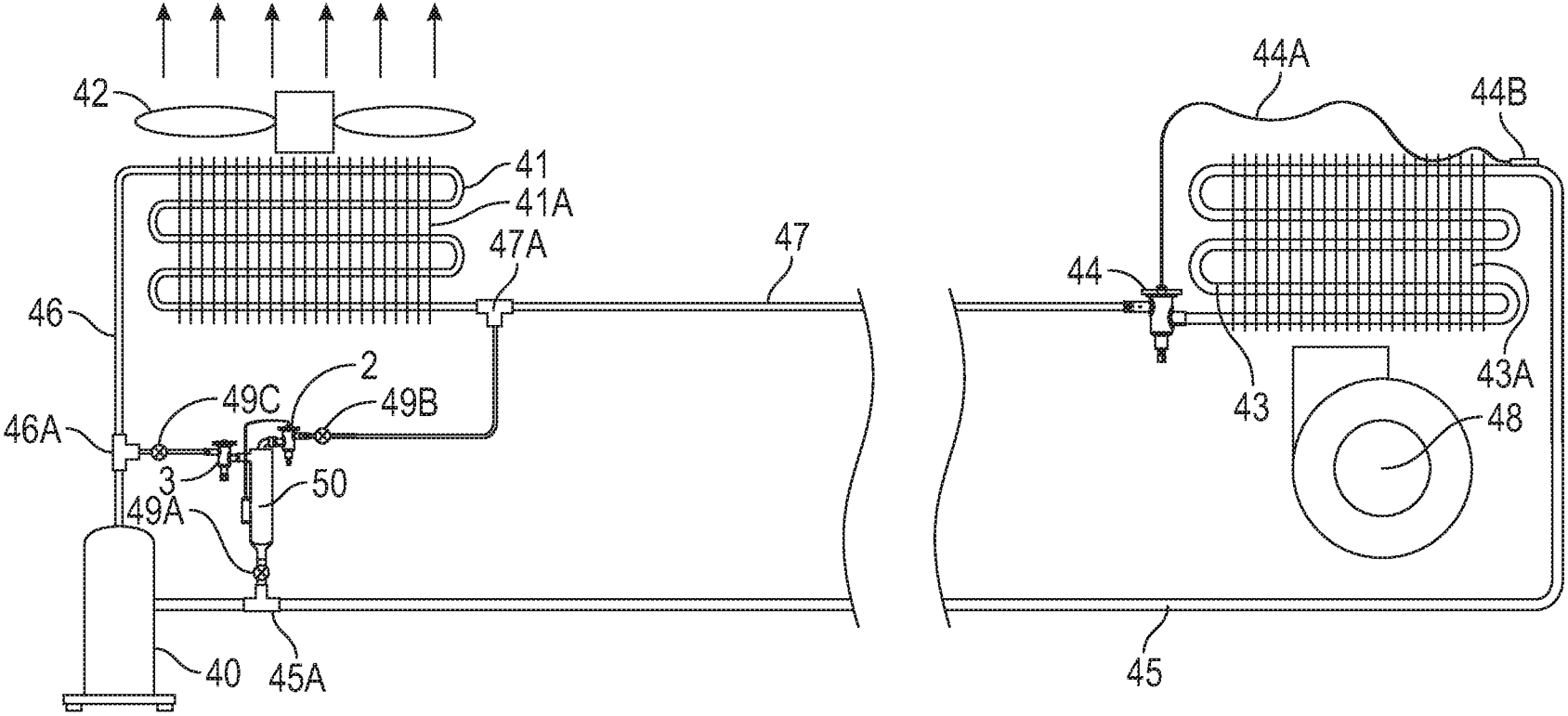
FIG. 5 is a schematic showing how an embodiment of a Refrigeration Capacity Control Device could be installed in one form of an air conditioning system according to the method described in this disclosure.

FIG. 5 is a schematic showing a method for incorporating an embodiment of a Refrigeration Capacity Control Device in one form of an air conditioning system. FIG. 5 depicts an RCCD (50) that is connected to one form of an air conditioning system via three connections. First, the RCCD is connected to a Suction Line (45) through an Optional Isolation Valve A (49A) that is located in between the RCCD and the Suction Line. Second, the RCCD is connected to the Compressor Discharge Line (46) through a Optional Isolation Valve C (49C), that is located in between the RCCD and the Compressor Discharge Line. Third, the RCCD is also connected to the Liquid Line (47) through an Optional Isolation Valve (49B), that is located in between the Liquid Line and the RCCD.

Although the embodiment disclosed in FIG. 5 uses an Optional Isolation Valve A (49A), an Optional Isolation Valve B (49B) and a Optional Isolation Valve C (49C), none of these are necessary for the operation of the RCCD; however including them may help in troubleshooting the remainder of the system or when determining the state of charge under partial load. Other possible embodiments of an RCCD incorporated into an air conditioning system could include either: (1) only an Optional Isolation Valve A (49A) between the discharge of the RCCD and the Suction Line (45) or (2) only an Optional Isolation Valve B (49B) and an Optional Isolation Valve C (49C) between the Liquid Line (47) and the Compressor Discharge Line (46), respectively.

The schematic of the system in FIG. 5 further shows the Compressor Discharge Line running through a Condensing Coil (41), that is in thermal communication with a First Means for Heat Dissipation (41A) (that is depicted as a series of spaced metal fins in FIG. 5), both of which are cooled by a Means for Moving Air (42), that is depicted as a fan in FIG. 5. The direction of the air flow in the embodiment depicted in FIG. 5 is shown by the arrows. The Liquid Line then runs through an Evaporator Coil (43), that is in thermal communication with a Second Means for Heat Dissipation (43A) (that is depicted as a series of spaced metal fins in FIG. 5). A Thermal Expansion Valve (44) is positioned before the Evaporator Coil (in an alternative embodiment, capillary tubing or other means can be used to reduce the pressure of the refrigerant). Capillary Tubing (44A) is depicted in FIG. 5 as connecting the Thermal Expansion Valve (44) which is on one side of the Evaporator Coil (43), with the Suction Line (45) which is located on the other side of the Evaporator Coil.

FIG. 5 further shows that Capillary Tubing (44A) connects the Thermal Expansion Valve (44) to a Temperature Sensing Bulb (44B) which is in thermal communication with the output side of the Evaporator Coil (43). The Thermal Expansion Valve compares the temperature at the exit of the evaporator and the pressure in the evaporator in order to determine how much liquid to let thru into the evaporator in order to guarantee approximately 10° F. of superheat. The return air from the air conditioned space is blown over the Evaporator Coil by a Centrifugal Fan (48) where the heat energy is transferred from the air to the refrigerant causing the liquid refrigerant to boil. After passing through the Evaporator Coil, the Liquid Line is redesignated as the Suction Line (45) and passes through a First Connection (45A) (shown as a tee in this embodiment) that connects to the Optional Isolation Valve A and the RCCD; the Suction Line then feeds into the Compressor (40).

FIG. 5 further depicts a method of continuously modulating the capacity of an air conditioning system, said system consisting of the following several steps.

First, an air conditioning system is established comprising the following, all of which are connected in a closed, continuous fluid system:

(A) A Compressor (40) to compress a gaseous refrigerant into a high pressure superheated refrigerant;

(B) A Condensing Coil (41) in which the high pressure superheated refrigerant first de-superheats and then condenses into a liquid refrigerant and then cools further into subcooled liquid refrigerant.

(C) A Pressure Reducing Device, such as a Thermal Expansion Valve (44), is used to reduce the pressure of the refrigerant to near the Suction Line pressure in order to cause a portion of the liquid refrigerant to flash boil, and to cool the liquid/gas mix to the critical temperature that corresponds to the lowered pressure (in alternative embodiments, a capillary tube, a piston orifice or other similar devices may be used as a Pressure Reducing Device); and (D) An Evaporator Coil (43) in which the remainder of the liquid refrigerant will evaporate while taking heat energy from the conditioned air stream. After all the liquid refrigerant has evaporated in the last portion of the Evaporator Coil, the temperature of the gaseous refrigerant will further increase to a slightly superheated level.

Figure 2:
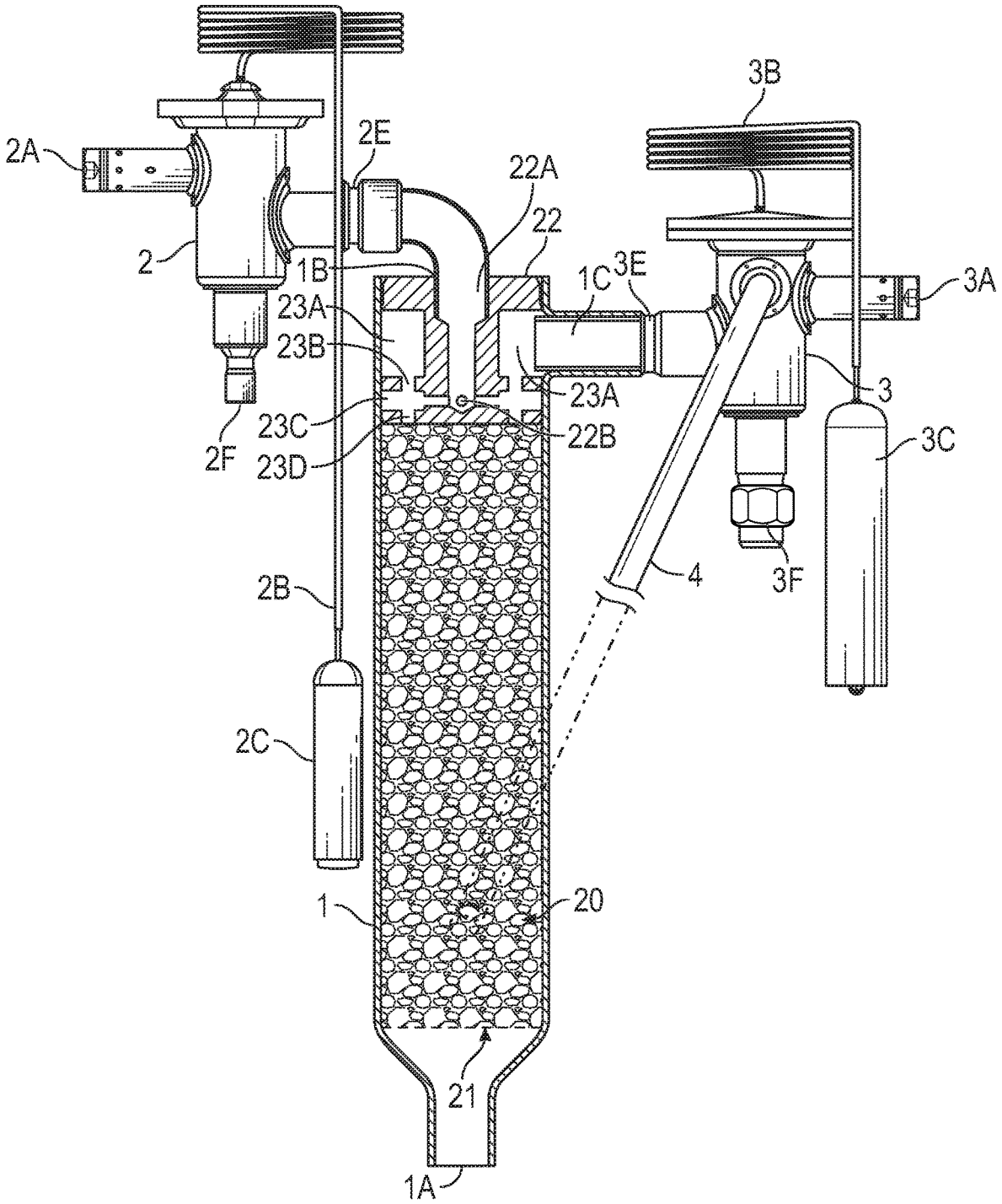
FIG. 2 is a cutaway view of the front of an embodiment, in one form, of a Mixing Chamber of a Refrigeration Capacity Control Device.

Second, an RCCD is interconnected to the air conditioning system as follows:

A. By placing a First Connection (45A) (a tee in the disclosed embodiment) in the Suction Line (45) immediately before the gaseous slightly superheated refrigerant returns to a first Compressor (40) and establishing gaseous refrigerant flow through the First Connection from the RCCD's Suction Connection Point (FIG. 2, 1A);

B. By placing a Second Connection (46A) (a tee in the disclosed embodiment) in the Compressor Discharge Line (46) immediately after the high pressure superheated refrigerant is discharged from the first Compressor (40) and establishing a flow of that high pressure superheated refrigerant to the Second Connection to the RCCD's Compressor Discharge Connection Point (FIG. 2, 3F); and C. By placing a Third Connection (47A) (a tee in the disclosed embodiment) in the Liquid Line (47) immediately after the subcooled liquid refrigerant exits the Condensing Coil (41) and establishing a subcooled liquid refrigerant flow into the Third Connection to the RCCD's Liquid Line Connection Point (FIG. 2, 2F).

Figure 6:
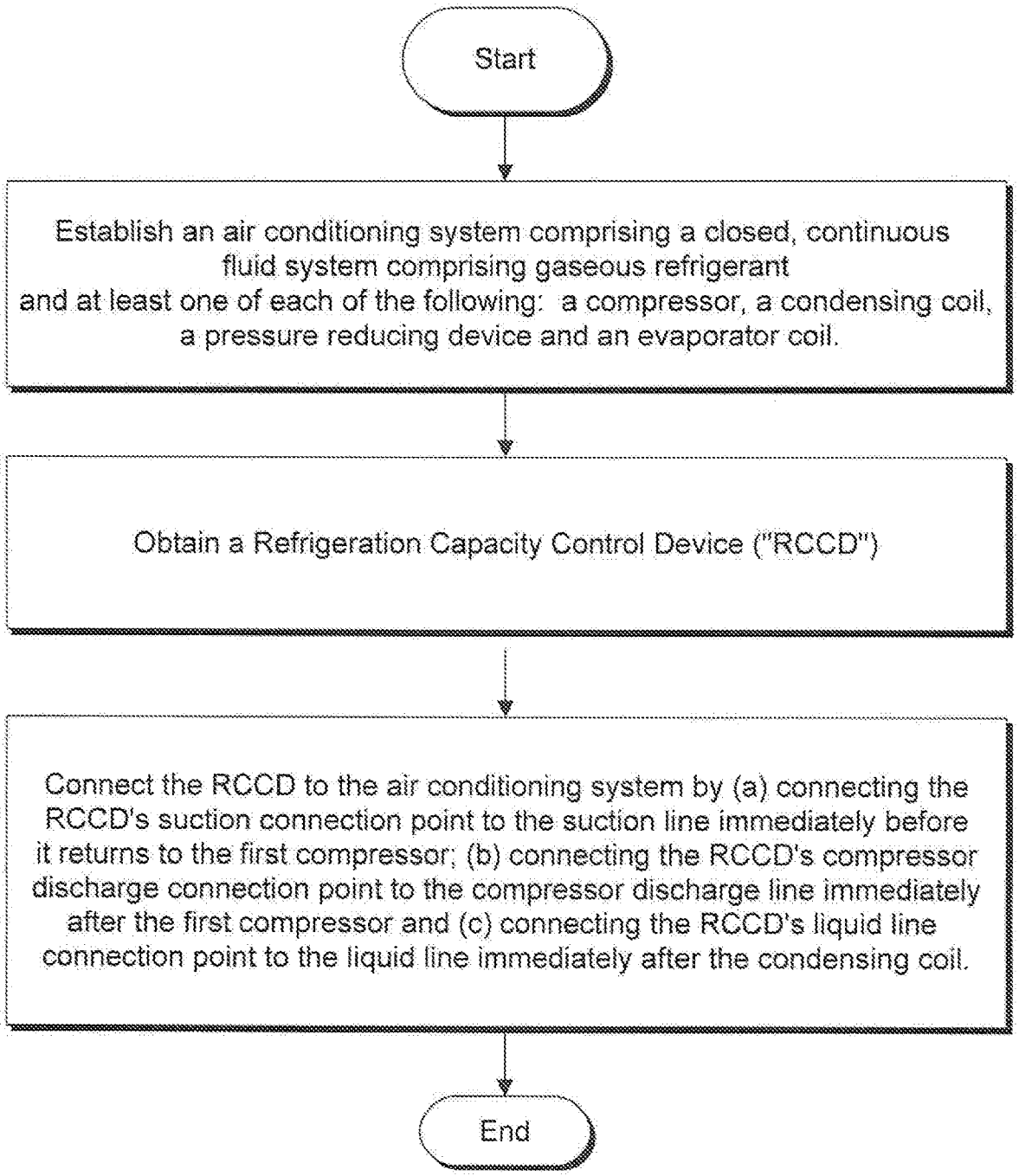
FIG. 6 is a flowchart showing the steps to install a Refrigeration Capacity Control Device in an air conditioning system.

FIG. 6 is a flowchart that summarizes the following steps of a method of continuously modulating the capacity of an air conditioning system, said method comprising the following steps:

Step 1) Establish an air conditioning system comprising a closed, continuous fluid system that comprises at least the following, all of which are fluidly connected:

A. At least one compressor to compress a gaseous refrigerant into a high pressure superheated refrigerant;

B. At least one condensing coil in which the high pressure superheated refrigerant first de-superheats and then condenses into a liquid refrigerant and then cools further into the subcooled liquid refrigerant;

C. At least one pressure reducing device which will reduce the pressure of the refrigerant to near the suction line pressure in order to cause a portion of the liquid refrigerant to flash boil, and cool the liquid/gas mix to the critical temperature that corresponds to the lowered pressure;

D. At least one evaporator coil in which the remainder of the liquid refrigerant will evaporate while taking heat energy from the conditioned air stream; after all of the liquid refrigerant has evaporated in the last portion of the evaporator coil, the temperature of the gaseous refrigerant will further increase to a slightly superheated level;

Step 2) Obtain the apparatus an RCCD;

Step 3) Connect an RCCD to the air conditioning system as follows:

A. Place a first connection in the suction line immediately before the gaseous slightly superheated refrigerant returns to the first compressor and establishing refrigerant flow from that first connection to the RCCD's suction connection point;

B. Place a second connection in the compressor discharge line immediately after the high pressure superheated refrigerant is discharged from the first compressor and establishing a flow of that superheated refrigerant through that second connection to the RCCD's compressor discharge connection point; and C. Place a third connection in the liquid line immediately after the subcooled liquid refrigerant exits the condensing coil and establishing a flow of that subcooled liquid refrigerant through that third connection to the liquid line connection point.

FIG. 2 is a cutaway view of the front of an embodiment, in one form, of a Mixing Chamber (1) of a Refrigeration Capacity Control Device. The RCCD is connected to the Liquid Line (FIG. 4, 47) by a Liquid Line Connection Point (2F) that allows liquid refrigerant to flow into a Liquid Injection Valve (2); the Liquid Injection Valve is connected to a Liquid Injection Valve Sensing Bulb (2C) by a Liquid Injection Valve Capillary Tube (2B) and is adjustable via an Optional Adjustment Access for Liquid Injection Valve (2A). A Flashed Liquid Connection Point (2E) fluidly connects to a Flashed Liquid Injection Point (1B), which fluidly connects to a Liquid Injection Port (22A) which allows liquid refrigerant to flow from the Liquid Injection Valve and is then sprayed through Orifices (22B) into the Lower Annular Chamber (23C) where it is mixed with hot gas received from the Low Pressure Regulating Valve (3) through a Superheated Gas Injection Point (1C) and Upper Annular Chamber (23A) through the Upper Annular Connecting Passage (23B) into a Lower Annular Chamber (23C) where the liquid and hot gas mix and then flow through an Annular Hot Gas Mixing Port (23D) into the Mixing Chamber (1) that contains a Thermodynamic Catalyst Fill Material (20).

In the embodiment depicted in FIG. 2, the Thermodynamic Catalyst Fill Material consists of brass wool; however, in addition to brass wool, other material that could function as Thermodynamic Catalyst Fill Material could include, but is not limited to, any other metal wool, a screen or baffle, a series of screens or baffles with openings, or alternating helical flow mixing inserts.

The embodiment shown in FIG. 2 further depicts an Optional Adjustment Access for Low Pressure Point (3A) which allows the evaporator pressure/temperature setpoint to be changed or adjusted. The Low Pressure Regulating Valve is shown as being equipped with an Optional LPRV Gas Spring Reservoir (3C) that is connected to the Low Pressure Regulating Valve by an LPRV Capillary Tube (3B). The Optional LPRV Gas Spring Reservoir comprises a method of providing resistance that uses gas or a mechanical spring. The Low Pressure Regulating Valve is depicted in FIG. 2 as having an Optional Pressure Sensing Line (4) which fluidly connects the Low Pressure Regulating Valve to a lower portion of the Mixing Chamber.

In the embodiment of the Low Pressure Regulating Valve (3) depicted in FIG. 2, the Optional LPRV Gas Spring Reservoir (3C) (which is fluidly connected to the Low Pressure Regulating Valve by a LPRV Capillary Tube (3B)) functions as a gas spring reservoir for the Low Pressure Regulating Valve. It will be readily apparent to those skilled in the art that other embodiments of a Low Pressure Regulating Valve could be used to regulate the proper low pressure in the system (for example, a mechanical spring powered low pressure regulating valve or an electronic low pressure regulating valve). The specific embodiment of a Low Pressure Regulating Valve that is used is not important; what matters is that some functional embodiment of a Low Pressure Regulating Valve is used to regulate the proper low pressure in the system.

In the embodiment illustrated in FIG. 2, the Low Pressure Regulating Valve discharges hot gas through an LPRV Discharge Port (3E) into an annular space known as an Upper Annular Hot Gas Reception Chamber (23A) that is located in the Mixing Nozzle Assembly (22). The Upper Annular Hot Gas Reception Chamber is in communication with the Lower Annular Hot Gas Chamber (23C) by way of an Upper Annular Connecting Passage (23B). Refrigerant can escape from the Lower Annular Hot Gas Chamber through the Annular Hot Gas Mixing Port (23D). Flashed liquid coming from the Liquid Injection Valve (2) is delivered through the Flashed Liquid Connection Point (2E), through the Liquid Injection Port (22A) and through a plurality of Orifices (22B) into the Lower Annular Hot Gas Chamber, where it is mixed with hot gas prior to exiting the Mixing Nozzle Assembly (22) and entering the Mixing Chamber which is filled with Thermodynamic Catalyst Fill Material (20). A Liquid Injection Valve Sensing Bulb (2C) of the Liquid Injection Valve (2) is attached to the lower portion of the Mixing Chamber (1) and ensures that a sufficient amount of liquid phase refrigerant is delivered to the Mixing Chamber (1) in order to cool the bypassed hot gas. A significant portion of capacity control comes from bypassing the cooling liquid phase refrigerant from the Liquid Line.

In the embodiment of the Liquid Injection Valve depicted in FIG. 2, the Liquid Injection Valve Sensing Bulb (2C) (which is fluidly connected to the Liquid Injection Valve by a Liquid Injection Valve Capillary Tube (2B)) functions as a Temperature Sensing Element for the Liquid Injection Valve. It will be readily apparent to those skilled in the art that other embodiments of Temperature Sensing Elements could be used to regulate the proper functioning of a Liquid Injection Valve (for example, the electronic liquid injection valve). As long as a functional embodiment of a Temperature Sensing Element is used to control the proper functioning of the Liquid Injection Valve, it is not important what specific embodiment of a Temperature Sensing Element is used.

The Thermodynamic Catalyst Fill Material (20) is held in the Mixing Chamber by a Means for Fill Material Retention (21). The mixing nozzle (22) provides a uniform spray of partially flashed liquid refrigerant suspended in the stream of superheated gaseous refrigerant. The purpose of the Thermodynamic Catalytic Fill Material is to provide an impingement surface for the remaining liquid refrigerant droplets, to induce the turbulence in the gaseous refrigerant, and to promote accelerated heat exchange between liquid and superheated gaseous refrigerant fractions.

As the mixture passes through the Thermodynamic Catalyst Fill Material, the remaining liquid is evaporated to a critical temperature gas as it cools the superheated gas and the two gasses (cooled superheated gas from the compressor discharge and evaporated gas from liquid line) further mix to provide uniformly heated (to a slight superheated level) gaseous refrigerant. The amount of superheat is determined by the setting on the Liquid Injection Valve. This mixture can return to the suction line via the Suction Connection Point (1A).

In FIG. 2, the Means for Fill Material Retention is a screen, but it could be any device or apparatus which is capable of retaining the Thermodynamic Catalyst Fill Material in the Mixing Chamber so that it does not enter into, block or clog the Suction Connection Point (IA).

Both the Liquid Injection Valve (2) and the Low Pressure Regulating Valve (3) are commercially available items.

Figure 1:
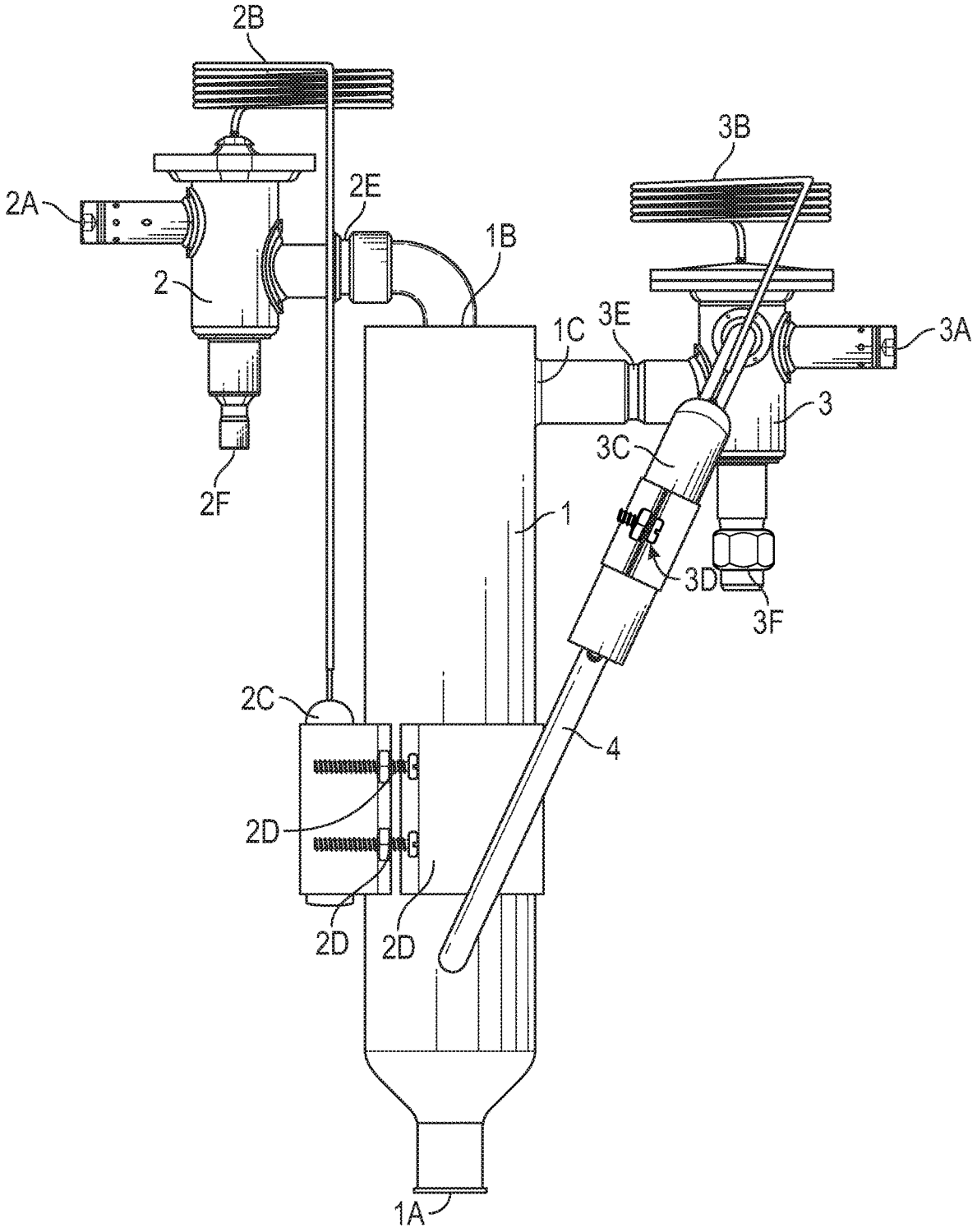
FIG. 1 is a front view of the outside of an embodiment, in one form, of a Refrigeration Capacity Control Device.

FIG. 1 illustrates a front view of the outside of an embodiment, in one form, of an RCCD. According to the embodiment depicted in FIGS. 1 and 5, the RCCD connects to one form of an air conditioning system as follows: the air conditioner's Suction Line (FIG. 5, 45) is connected to the Suction Connection Point (1A); the air conditioner's liquid line (FIG. 5, 47) is connected to the Liquid Line Connection Point (FIG. 1, 2F); and the air conditioner's Compressor Discharge Line (FIG. 5, 46) is connected to the Compressor Discharge Connection Point (FIG. 1, 3F) in the manner shown in FIG. 5.

In the embodiment depicted in FIG. 1, refrigerant may enter into the RCCD via two different pathways simultaneously. First, a subcooled liquid refrigerant may enter the RCCD via a Liquid Line Connection Point (2F) and then pass through a Liquid Injection Valve (2). Second, superheated gaseous refrigerant may enter the RCCD via a Compressor Discharge Connection Point (3F), thereby entering into a Low Pressure Regulating Valve (3) which can discharge into the RCCD's Superheated Gas Injection Point (1C).

FIG. 1 similarly depicts an embodiment which is equipped with a Means for Securing LPRV Gas Spring Reservoir (3D) to the Optional Pressure Sensing Line (4). It is not necessary to secure the Optional LPRV Gas Spring Reservoir to the Optional Pressure Sensing Line, but it is useful for purposes of convenience.

FIG. 1 further depicts an embodiment which is equipped with a Means for Securing Liquid Injection Valve Sensing Bulb (2D) that is conformably made to fit over a Mixing Chamber (1) and the Liquid Injection Valve Sensing Bulb (2C); FIG. 1 depicts an embodiment in which the Means for Securing Liquid Injection Valve Sensing Bulb (2D) is at least one strap conformably made to fit over the mixing chamber and the liquid injection valve sensing bulb; this strap may be comprised of copper, steel, metal or other material which will provide good thermal conductivity between the mixing chamber and the liquid injection valve's Temperature Sensing Element.

Figure 3:
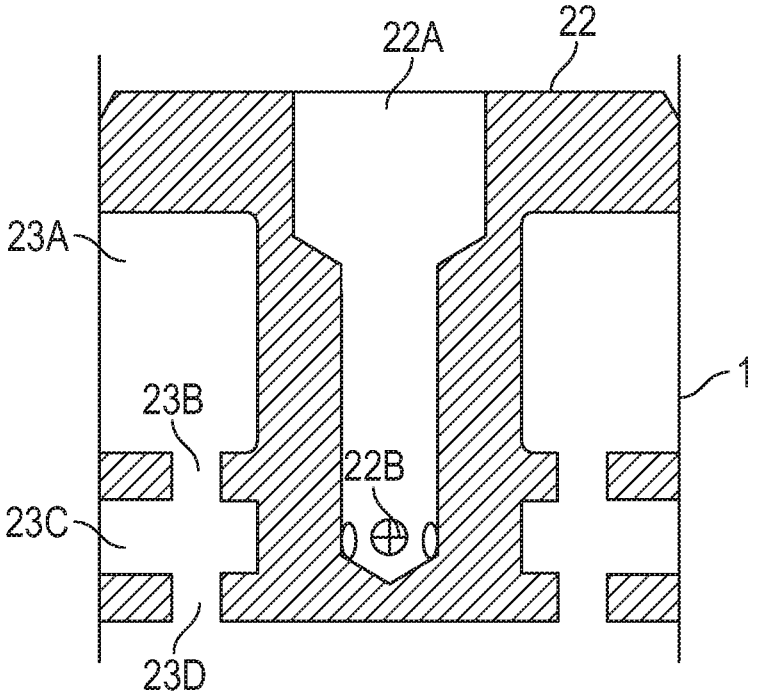
FIG. 3 is a cutaway view of the front of an embodiment, in one form, of a Mixing Nozzle Assembly in a Refrigeration Capacity Control Device.

FIG. 3 is a cutaway view of the front of an embodiment, in one form, of a Mixing Nozzle Assembly (22) in a Refrigeration Capacity Control Device. That figure depicts a Liquid Injection Port (22A) leading from a Flashed Liquid Injection Point (FIG. 2, 1B) that is fluidly connected to the Liquid Injection Valve and into one or more Orifices (22B), as well as an Upper Annular Hot Gas Reception Chamber (23A) that receives superheated gaseous refrigerant from an LPRV Discharge Port (FIG. 2, 3E) and which is connected to a Lower Annular Hot Gas Chamber (23C) by means of an Upper Annular Connecting Passage (23B) and which is in fluid communication with an Annular Hot Gas Mixing Port (23D) that discharges into the Mixing Chamber (FIG. 2, 1).

Figure 4:
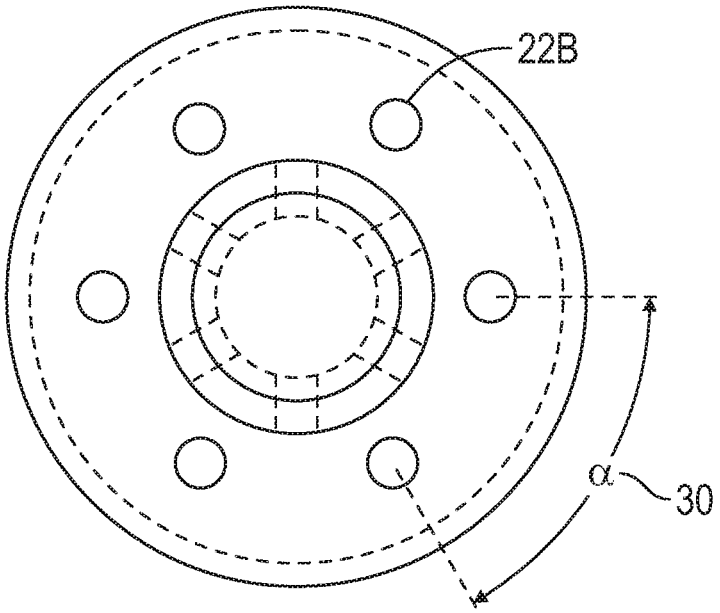
FIG. 4 is a bottom view of an embodiment, in one form, of the Orifices of a Mixing Nozzle Assembly in a Refrigeration Capacity Control Device.

FIG. 4 depicts a bottom view of an embodiment, in one form, of a plurality of Orifices (22B) located in a Mixing Nozzle Assembly (22) in a Refrigeration Capacity Control Device. The embodiment disclosed in FIG. 4 depicts a plurality of Orifices which are evenly spaced one from another by a certain Angle Between Nozzle Orifices (30), shown as the Greek letter alpha (a) in FIG. 4. The embodiment depicted in FIG. 4 utilizes an Angle Between Nozzle Orifices of 60° with 6 orifices. Other embodiments of a plurality of Orifices are possible using differing Angles Between Nozzle Orifices and combinations of Angles Between Nozzle Orifices. Still other embodiments are possible using odd numbers of Orifices, using irregularly spaced Orifices, using Orifices whose centers are not equidistantly located from a common center of the Mixing Nozzle Assembly and using Orifices which have varying configurations one from another. All such embodiments are claimed by this application.

Another embodiment of the RCCD, known as a thermodynamic homogenization device, can be created for use in processes other than refrigeration capacity control wherein there is a need for thermodynamic homogenization of liquid and gaseous components of same or different substances. One such application could include desuperheating of superheated steam by injecting water thru the liquid injection port (FIG. 2, 22*a*) and superheated steam thru the gaseous phase input port (FIG. 2, 1C). A thermodynamic homogenization device would be comprised of the following elements which are depicted in FIG. 2: a Mixing Chamber (1); a Mixing Nozzle Assembly (22); Thermodynamic Catalyst Fill Material (20); and a Means for Fill Material Retention (21).

The specific alternatives, embodiments, and methods thereof as disclosed and illustrated herein are not to be considered in a limiting sense, as numerous variations are possible. The present disclosure includes all novel and non-obvious combinations and sub-combinations of the various elements, features, functions, properties, methods, and/or steps disclosed herein. The following claims particularly point out certain combinations and sub-combinations that are directed to one of the disclosed inventions and are novel and non-obvious. Inventions embodied in other combinations and sub-combinations of features, functions, elements, properties, methods, and/or steps may be claimed through amendment of the present claims or presentation of new claims in this or a related application. Such amended or new claims, whether they are directed to a different invention or directed to the same invention, whether different, broader, narrower, or equal in scope to the original claims, also are regarded as within the subject matter of the present disclosure.

While the description of several embodiments has been presented and while the illustrative embodiments are described in detail, it is not the intention of the applicant to restrict or in any way limit the scope of the appended claims to such detail. Applicant intends by this application to cover all possible embodiments that are described by the claims, even if such embodiments are not specifically shown or described in the Figures or in the Detailed Description of the Embodiments. That is, the claims in their broader aspects are therefore not limited to any of the specific details or to any of the representative apparatus and illustrative examples shown and described in the Figures and the specification. Accordingly, departures may be made from such details without departing from the spirit or scope of applicant's general concept as claimed.

In the event that any of the patent documents that are incorporated by reference herein define or use a term in a manner that is inconsistent with either the non-incorporated disclosure of the present application or with any of the other incorporated patent documents, the non-incorporated disclosure of the present application shall control with respect to the present application, and the term or terms as used in an incorporated patent document shall only control with respect to the document in which the term or terms are defined or used.

The invention claimed is:

1. An apparatus, known as a refrigeration capacity control device, to continuously modulate the refrigeration capacity in an air conditioning system comprising a compressor, a condensing coil, a compressor discharge line that allows the flow of gaseous refrigerant from the compressor to the condensing coil, an evaporator coil, a liquid line that allows the flow of liquid refrigerant from the condensing coil to the evaporator coil, and a suction line that allows the flow of gaseous refrigerant back to the compressor from the evaporator coil, the apparatus operating by controlling recirculation to the compressor of gaseous refrigerant from the compressor discharge line and recirculation to the compressor of liquid refrigerant from the liquid line;

the apparatus comprising:

a liquid injection valve connected to the liquid line of the air conditioning system between the condensing coil and the evaporator coil to regulate the flow of liquid refrigerant from the liquid line;

a low pressure regulating valve connected to the compressor discharge line of the air conditioner system between the compressor and the condensing coil to regulate the flow of gaseous refrigerant from the compressor discharge line;

and a mixing chamber comprising a suction connection point connected to the suction line of the air conditioning system between the evaporator coil and the compressor that allows refrigerant to be discharged into the suction line, a flashed liquid injection point that receives liquid refrigerant from the liquid injection valve, a superheated gas injection point that receives gaseous refrigerant from the low pressure regulating valve, a mixing nozzle assembly, a thermodynamic catalyst fill material within the mixing chamber, and a means for thermodynamic catalyst fill material retention;

said liquid injection valve comprising:

a liquid line connection point that receives liquid refrigerant from the liquid line of the air conditioning system between the condensing coil and the evaporator coil;

a liquid refrigerant temperature sensing element, comprising a liquid injection valve sensing bulb that senses temperature from the side wall of the mixing chamber, said liquid refrigerant temperature sensing element being used to control the flow of liquid refrigerant; and a flashed liquid connection point that discharges liquid refrigerant to the flashed liquid connection point on the mixing chamber;

said low pressure regulating valve comprising:

a compressor discharge connection point that receives gaseous refrigerant from the compressor discharge line of the air conditioning system between the compressor and the condensing coil;

a gaseous refrigerant temperature sensing element, comprising a low pressure regulating valve gas spring reservoir that senses temperature from the exterior wall of a pressure sensing line, said gaseous refrigerant temperature sensing element being used to control the flow of gaseous refrigerant;

the pressure sensing line conducting a flow of refrigerant from the low pressure regulating valve to the thermodynamic catalyst material in the mixing chamber with the flow of refrigerant passing through said pressure sensing line bypassing the mixing nozzle assembly; and a low pressure regulating valve discharge port that discharges gaseous refrigerant to the superheated gas injection point on the mixing chamber;

said means for thermodynamic catalyst fill material retention comprising:

a screen or wire capable of preventing the thermodynamic catalyst fill material from passing out of the suction connection point;

the thermodynamic catalyst fill material being contained within the mixing chamber at the top by the mixing nozzle assembly and at the side by the interior of the outer wall of the mixing chamber; and the mixing nozzle assembly comprising:

the flashed liquid injection point of the mixing chamber that connects to the liquid injection valve and receives flashed liquid refrigerant from said liquid injection valve;

a liquid injection port that receives flashed liquid refrigerant from the flashed liquid connection point and allows the flow of said flashed liquid refrigerant to a plurality of orifices;

the plurality of orifices within the liquid injection port and through which said flashed liquid refrigerant is sprayed out of said liquid injection port and into a lower annular hot gas reception chamber;

the lower annular hot gas reception chamber extending from the outer wall of the liquid injection port that contains the plurality of orifices to the side wall of the mixing chamber, said lower annular hot gas reception chamber including the following openings:

an upper annular connecting passage through which gaseous refrigerant may be received into said lower annular hot gas reception chamber from an upper annular hot gas reception chamber, said upper annular connecting passage comprising an inner wall that is parallel to and outside the circumference of the liquid injection port; and an outer wall that is parallel to and inside the circumference of the wall of the refrigeration capacity control device;

an annular hot gas mixing port through which refrigerant can escape into the mixing chamber that is filled with the thermodynamic catalyst fill material, said annular hot gas mixing port including:

an inner wall that is parallel to and outside the circumference of the liquid injection port; and an outer wall that is parallel to and inside the circumference of the wall of the refrigeration capacity control device;

an upper annular hot gas reception chamber that receives gaseous refrigerant, said upper annular hot gas reception chamber extending from the wall of the refrigeration capacity control device inward to an interior wall that is parallel to and with a greater circumference than the liquid injection port, said upper annular hot gas reception chamber further including the following outlets:

the upper annular connecting passage through which gaseous refrigerant passes through to the lower annular hot gas reception chamber; and a superheated gas injection point that receives superheated gaseous refrigerant from the low pressure regulating valve discharge port and through which superheated gaseous refrigerant may enter the upper annular hot gas reception chamber.

2. The apparatus of claim 1 wherein the thermodynamic catalyst fill material is comprised of a material chosen from the following group of materials:

brass wool;

a metal wool other than brass wool;

multiple screens;

at least one baffle; and helical flow mixing inserts.

3. The apparatus of claim 1 wherein a means for securing the liquid injection valve sensing bulb is employed to secure the liquid injection valve sensing bulb to the exterior wall of the mixing chamber, said means comprising:

a strap conformably made to fit over the mixing chamber and the liquid injection valve sensing bulb, said strap chosen from copper, steel, metal or other material which will provide thermal conductivity between the mixing chamber and the liquid injection valve sensing bulb.

* * * * *